United States Patent [19]

Marten

[11] 4,230,372

[45] Oct. 28, 1980

[54] DUAL ROCK CUTTER WHEEL TRENCHER

[75] Inventor: Edward N. Marten, Von Ormy, Tex.

[73] Assignee: H. B. Zachry Company, San Antonio, Tex.

[21] Appl. No.: 966,338

[22] Filed: Dec. 4, 1978

[51] Int. Cl.[2] ..... E21C 29/24; E21C 25/16

[52] U.S. Cl. ..... 299/39; 173/43; 299/15; 299/72; 299/75

[58] Field of Search ..... 299/10, 15, 39, 75, 299/72; 173/43

[56] References Cited

U.S. PATENT DOCUMENTS

| | | | |
|---|---|---|---|
| 428,951 | 5/1890 | Richards | 299/72 |
| 2,517,267 | 8/1950 | Watson | 299/72 |
| 3,460,691 | 8/1969 | Wieger et al. | 173/43 X |
| 3,596,997 | 8/1971 | Valantin | 299/15 X |
| 3,785,705 | 1/1974 | Binger et al. | 299/15 X |

*Primary Examiner*—Ernest R. Purser

*Attorney, Agent, or Firm*—Hubbard, Thurman, Turner, Tucker & Glaser

[57] ABSTRACT

Apparatus and method for digging deep vertical walled trenches in solid rock such as limestone. The apparatus comprises a base supported by four crawler type traction means. A turntable is translatably carried by the base and in turn supports a prime mover and a pivoted extendable boom including means for rotating the boom about its longitudinal axis. A dual cutter is supported on the end of the thus articulated boom and is assembled so that the outermost cutter teeth are wider than any other part of the boom assembly. The trenching method includes cutting a pair of narrow slots by means of the rock saws and then removing material between the slots.

10 Claims, 2 Drawing Figures

DUAL ROCK CUTTER WHEEL TRENCHER

BACKGROUND OF THE INVENTION

This invention relates to apparatus and methods for digging trenches in the earth's surface for laying pipes and the like, and more particularly to apparatus and methods for cutting narrow vertical walled trenches in solid rock such as limestone.

References which are known to the present applicant and which are believed to be relevant to the present invention include the following U.S. Pat. Nos. 1,472,563 issued to Loken on Oct. 30, 1923; 2,780,452 issued to Marcerou on FEB. 5, 1957; and 3,364,602 issued to Renzaglia on Jan. 23, 1968.

The Loken patent discloses improvements to the bucket wheel trenching machines commonly used for pipe laying. Such machines are quite useful in most normal soils and even in some soft rocks, but the depth of cut is limited by the diameter of the bucket wheel itself. For very large depths, the equipment becomes quite massive.

The Marcerou patent teaches a rock cutting machine for use in quarries. The machine is manually adjustable and is designed to drive a pair of relatively small rock cutter wheels into the face of a stone wall while a head tool cuts a hole for the driving equipment and a pair of side cutters cut side grooves for stabilizing the device as it penetrates into the rock.

The Renzaglia patent teaches the use of a larger cutter wheel pivotally mounted on the back of a tractor for use in cutting roots. It is apparent from the illustrated apparatus that the depth of cut provided by this apparatus is limited to somewhat less than the radius of the cutter wheel.

Thus it is seen that while rock saws or cutter wheels have been known and used for various purposes, they have not been applied to the cutting of trenches for laying of pipelines. It can also be seen that it is desirable to provide a trench cutting apparatus capable of digging deep, narrow trenches in hard rocky materials which is relatively lightweight and simple compared to the prior known devices.

SUMMARY OF THE INVENTION

Accordingly, an object of the present invention is to provide a trench rock saw which can cut vertical walled narrow trenches to relatively great depth in solid rock materials.

Another object of the present invention is to provide a relatively simple and lightweight trenching machine capable of cutting trenches to relatively great depths.

Another object of the present invention is to provide an improved trenching machine and method of cutting trenches.

Trenching apparatus according to the present invention includes a mobile base having traction means, a turntable translatably supported on said mobile base, a pivoted extendable boom supported on said turntable, which boom is also rotatable about its longitudinal axis, and a parallel pair of cutter wheels supported on the end of the boom. In use, the articulated boom is used to align the cutter wheels with a trench path while the cutter wheels are used to cut a pair of narrow slots in the rock base. Material between the slots is then removed by conventional means and the cutter wheels may be returned to the trench in precise alignment for subsequent cuts until the desired trench depth is reached.

BRIEF DESCRIPTION OF THE DRAWINGS

The present invention may be better understood by reading the following detailed description of the preferred embodiment with reference to the accompanying drawings, wherein.

DESCRIPTION OF THE PREFERRED EMBODIMENT

Figure 1:
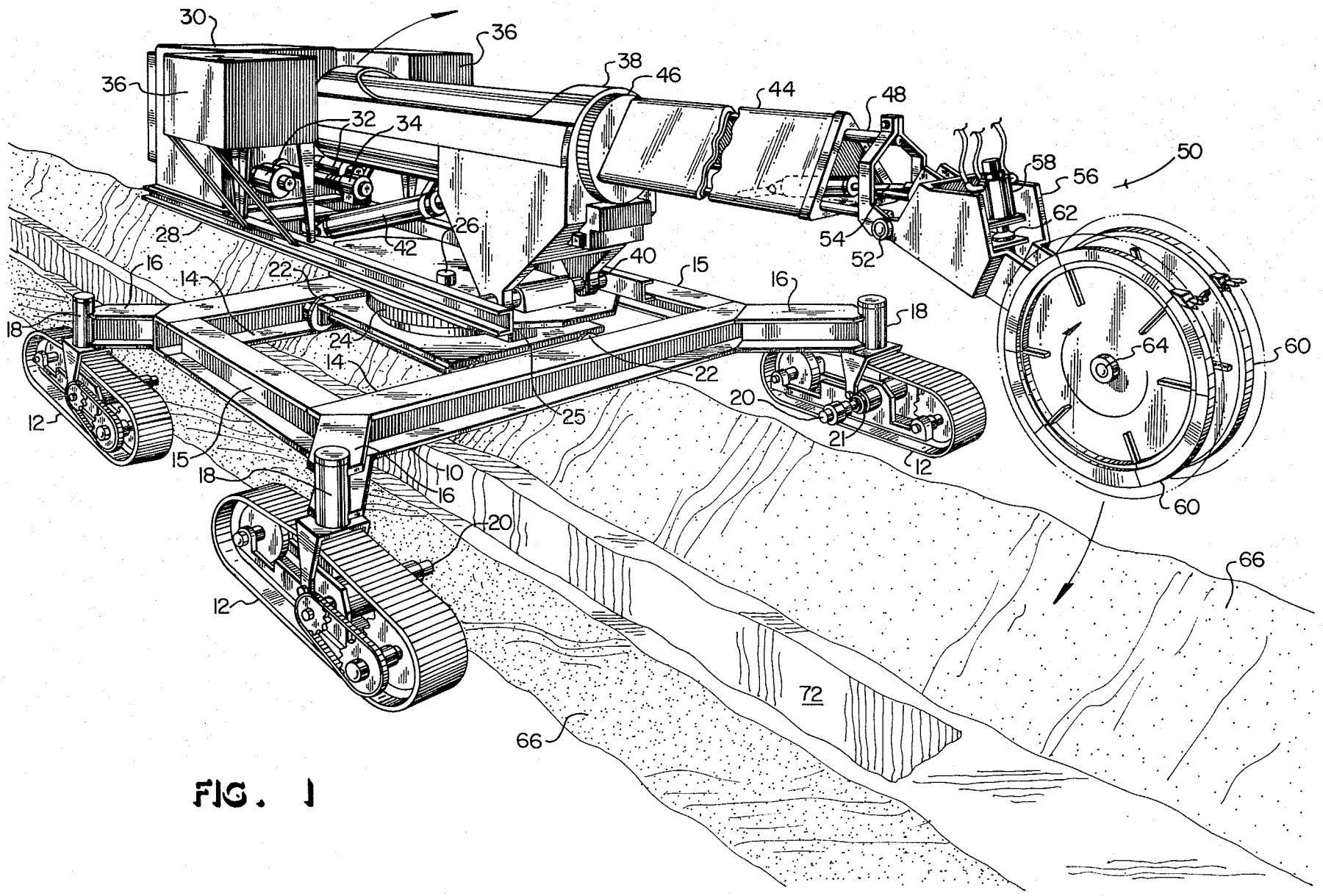
FIG. 1 is a perspective view of apparatus according to the present invention.

With reference now to FIG. 1, most of the details of the preferred embodiment are illustrated in a perspective view. A base 10 comprising steel I-beams assembled in a rectangle is supported on its four corners by traction units 12. Two of the I-beams forming base 10 also form a pair of transverse rails 14 for supporting the rest of the apparatus. The remaining two I-beams 15 may also be used for cross rails in a slightly modified form of the present equipment. Arms 16 extend diagonally out from the corners of base 10 and connect the traction units 12 to the base. A pivot 18 is provided at the end of each arm 16 to allow the traction units 12 to move in essentially any direction and also to allow the arms 16 to be raised relative to traction units 12. It can be seen that since base 10 and arms 16 form a rigid, flat surface and the surface of the earth is rarely perfectly flat, especially in construction areas, it is necessary that at least some of the arms 16 have the capacity for being raised relative to the traction units 12. While, as illustrated, each of the traction units 12 is independently free to rotate about its pivot 18, it is normally desirable to provide lateral tie rods to keep pairs of the traction units 12 aligned with each other. In the preferred form, each of the traction units 12 is a conventional crawler unit riding on steel treads and driven by a fluid-drive motor 20 through a gear reducer 21. For general use, the treads of traction units 12 are not cleated, making it more important that the extension arms 16 have the ability to be raised relative to the traction units 12 to assure even loading of each of the units 12.

Four rollers or wheels 22 are provided for riding in the rails 14 and, in turn, supporting a turntable 24. The rails 14 and rollers 22 provide, in the preferred embodiment, means for moving the rest of the apparatus of FIG. 1 laterally relative to the base. The turntable 24 is conventional and is driven by a fluid-drive motor 25 to provide rotational motion to the unit about a vertical axis 26. A second frame 28 is supported on turntable 24 to pivot around axis 26.

Supported on frame 28 is a prime mover 30 which is the preferred embodiment is a diesel engine. The engine 30 drives a pair of hydraulic fluid pumps 32 for driving the traction motors 20 and the cutter head motor described below. The engine also drives another pump 34 for operating the numerous hydraulic cylinders which position the various elements of the present apparatus. A pair of hydraulic fluid tanks 36 provide the storage capacity for the hydraulic fluid used to operate the motors and cylinders.

The second basic unit supported by frame 28 is an extendable boom unit 38. In the preferred embodiment, unit 38 is a unit commonly used for truck mounted backhoes and the like. The unit 38 is attached to frame 28 by means of a pivot axle 40 and the pivot angle is controlled by a pair of hydraulic cylinders 42. The boom portion 44 of unit 38 is rotatable about its longitudinal axis by means of a ring gear arrangement 46. An extendable portion 48 of boom 44 telescopes from within boom 44 to provide a variable extendable length. Each of the various motions of boom unit 38 is hydraulically controlled and powered from the prime mover 30. It can be seen from the arrangements so far described that the extendable boom portion 48 may, with respect to the base 10, translate laterally, rotate about a vertical axis, pivot about a horizontal axis, rotate about its own longitudinal axis, and extend along its longitudinal axis. These motions are, of course, additive to the basic motion of frame 10 which is able to translate by means of traction means 12 in essentially any direction on the surface of the earth.

Attached to the end of extendable boom 48 is a dual cutter unit shown generally as 50. Cutter unit 50 is attached to boom 48 by pivot 52 and a hydraulic cylinder shaft 54. The dual cutter 50 comprises a main body 56 containing reduction gearing within it and supporting a fluid-drive motor 58 and a pair of cutter wheels 60. Motor 58 drives directly into a gear reduction unit 62. The reduction unit 62 in turn drives a double chain drive speed reduction arrangement shown in more detail in FIG. 2. The two cutter wheels 60 are eight feet in diameter (seven feet without carbide teeth) and the teeth are spread over a five inch width. The cutter wheels are designed to rotate up to 105 revolutions per minute. The cutter wheels 60 are mounted on opposite ends of a shaft 64 which has an overall length less than the maximum spread between the outer teeth on the cutter wheels. The details of this arrangement are better illustrated with respect to FIG. 2.

Figure 2:
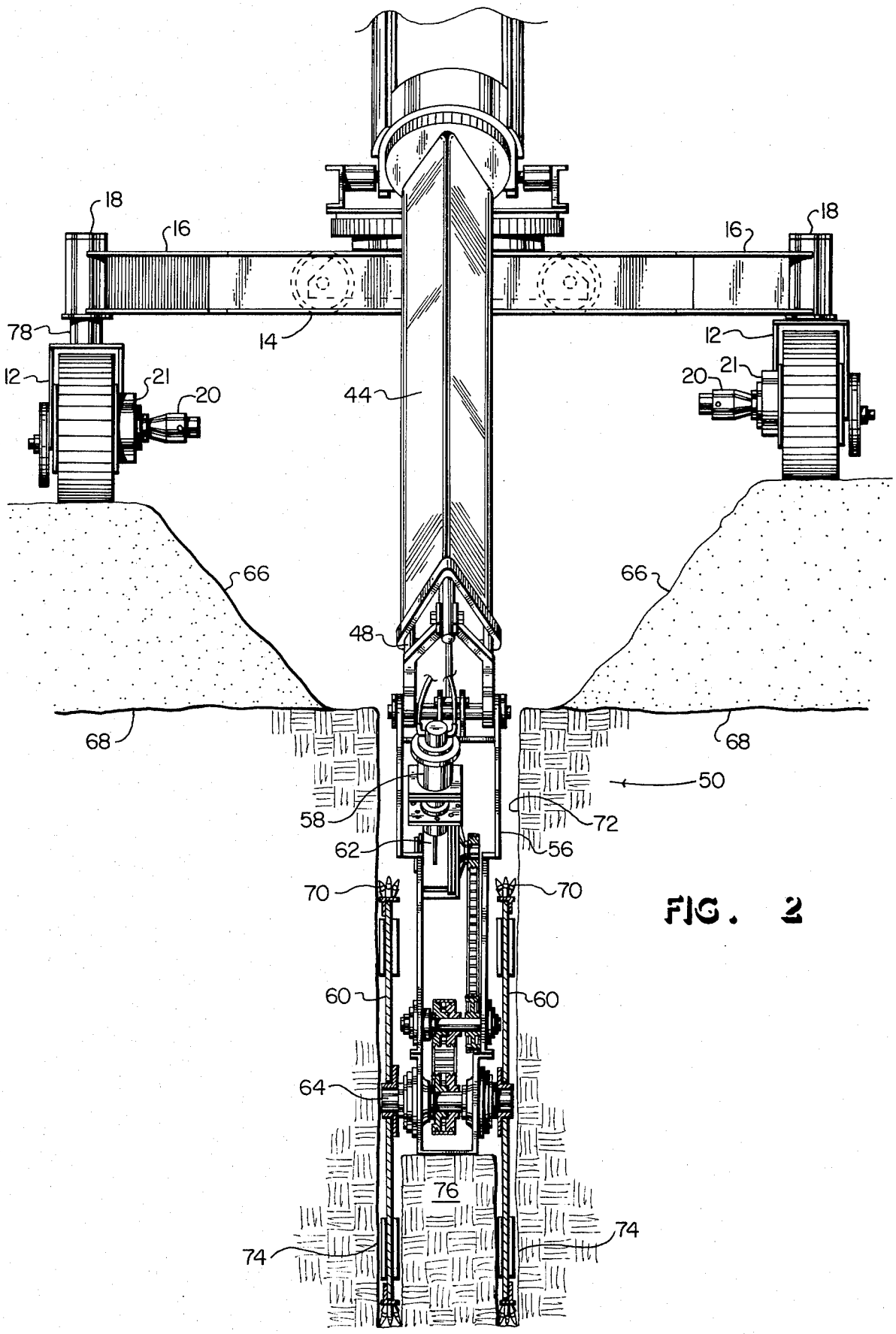
FIG. 2 is a partial front view of apparatus according to the present invention illustrated in place within a rock trench.

With reference now to FIG. 2, a front view of the apparatus in FIG. 1 is illustrated in place cutting a deep trench in a rocky material. The same designation numbers are used to indicate the parts which are also illustrated in FiG. 1. In particular, the traction units 12 are shown resting on the top of banks 66 comprising loose or soft surface topsoil or sand. Below an interface 68 is a subsurface rocky material such as limestone material. While limestone is relatively soft stone and could sometimes be cut by previously known trenching equipment, such cutting could be done only at a slow rate and would cause extreme wear on the equipment. The cutter wheels 60 have teeth 70 designed for cutting this type of rocky material at a fairly high rate, but equipment for using such cutter wheels has not heretofore been provided which could cut a trench deeper than about the radius of the cutter wheel. As noted above, the shaft 64 is shorter than the space between outside teeth 70 of cutter wheels 60 which in the preferred embodiment is about thirty inches. Likewise, the housing 56 in which the driving mechanism is contained and even the extendable boom 48 and boom 44 are smaller than this thirty inch dimension so that the entire boom and drive mechanism may be extended down into a previously cut thirty inch wide trench. As illustrated in FIG. 2, an essentially vertical walled trench 72 has been cut into the solid rock portion of the earth below the loose material 66. As illustrated, trench 72 was about eight feet deep when dual cutter 50 was inserted to make another cut at the bottom. The cutter 50 provides a pair of narrow slots 74 approximately three feet deep and each five inches wide with the outer edges of the cuts being approximately thirty inches apart. It can be seen that it is very important in this operation that the large cutter wheels 60 are correctly positioned within the previously cut trench 72 so that the contact of teeth 70 is limited to the bottom of the trench where the desired cut is to be made. Any misalignment of the cutter 60 would cause them to bite into the side walls of the trench greatly increasing the force needed to drive the wheels 60 and either stopping the cutting operation or damaging the wheels or the equipment.

In operation, a trench is cut in hard rock by first removing the soft topsoil layer to form banks 66 by use of conventional earth moving equipment. When the hard rock interface 68 is reached, the trench rock cutter according to the present invention is positioned over the topsoil cut 66 as shown in FIG. 2. The frame 28 is then positioned over the center of the cut by movement along rails 14 by hydraulic cylinder means not shown. The boom unit 38 is then rotated about vertical axis 26, tilted about pivot axis 40 and the boom is extended and rotated until the cutter wheels 60 contact the top surface of the rock formation. Before cutting begins, the wheels are carefully aligned to be parallel with the direction of the desired cut. The cutter wheels are then rotated and lowered into the rock face until they reach the maximum depth of about three feet. The entire unit may then be translated down the trench by means of traction units 12 as the parallel grooves 74 are cut into the rock face. As the entire unit moves, the boom unit 38 may be continually readjusted to ensure the parallel operation of the blades with respect to the direction of the desired cut. After the parallel cuts 74 have been made, conventional means such as backhoes, side chisels, or explosives are used to remove a central block portion 76 remaining between the two side cuts. It can be seen that once the side cuts 74 are made, the central portion 76 is much more easily removed than would be otherwise possible. After the first pass has been made and the central portion 76 has been removed, the rock cutter of the present invention may be returned to the starting point and repositioned. The essentially universal articulation of the boom unit 38 is then employed to lower the cutter blades 60 into the previously cut trench with essentially no contact with the side walls of the trench. In this way, the cutter blades may be lowered into the bottom of the previously cut trench to provide another pair of narrow grooves along the length of the trench. The remaining rock 76 is again removed by conventional means and the process may be repeated until a desired depth is reached. With the fairly simple apparatus of the present invention, total trench depths of approximately twenty-seven feet may be provided. It can be seen that with very little additional increase in size and weight of the equipment, the total cut depth may be increased by simply providing a longer boom arrangement 44.

As noted above, the base 10 is rectangular with the two rails 14 comprising the long sides of the rectangle. The remaining short sides 15 may also be used as rails for supporting the apparatus by wheels 22. Thus, if it is desired to operate with smaller spacing between traction unit 12, the base 10 may be rotated 90° relative to wheels 22 with an appropriate change in wheel 22 spacing. The traction means 12 would then also be pivoted 90° on pivot units 18 and the entire unit would operate as described above, but with narrowed spacing between traction units 12. In the preferred embodiment, the base 10 is about seven by ten and one half feet. As an alternative, the connection between traction support arms 16 and the base 10 may be made flexible to allow the space between traction units 12 to be varied.

As noted above, traction unit pivots 18 are provided with means for raising base 10 relative to the units 12. This is shown as shaft 78 in FIG. 2. Not only does this improve traction, but it also allows base 10 to be levelled, which greatly facilitates alignment of cutter wheels 60 with a previously cut trench. But it can be seen that even if the base 10 is tilted with respect to the vertical, the articulation which is otherwise provided is sufficient to perfectly align the cutter wheels 60 within a previously cut trench.

The apparatus thus far described is adapted for cutting only a single width of trench, i.e. thirty inches. A simple means has been found for increasing the width of the cut. While shaft 64 could obviously be modified to have a length greater than thirty inches, it has been found more convenient to use hub extensions between the ends of shaft 64 and cutter wheels 60. Up to three, six inch extensions may be used on each end of shaft 64 to provide a trench width of up to sixty-six inches. While wider trenches provide more clearance for boom 44, the universal articulation of the cutter mechanism is still required to properly reenter a trench.

While many are not illustrated, for simplicity, it is apparent that fluid-driven cylinders, etc., are used to control the various allowable motions of the present apparatus. Each of the fluid-driving means derives power from the prime mover 30.

While the present invention has been illustrated in terms of specific apparatus and methods, it is apparent that various modifications can be made within the scope of the present invention as defined by the appended claims.

I claim:

1. Apparatus for cutting a trench in rock comprising:

a supporting base, traction means carried by and movably supporting said base, a turntable carried by said base by means for translatably moving said turntable relative to said base, an extendable boom pivotally supported by said turntable, whereby said boom may pivot about a horizontal axis, means for rotating said boom about its longitudinal axis, and a double rock cutter carried by said boom, said rock cutter including a pair of rock cutter wheels attached to a shaft, said shaft having a length, and said boom having a width less than the maximum distance between outside teeth on said cutter wheels.

2. Apparatus according to claim 1 wherein said base comprises a plurality of steel beams forming a rectangle.

3. Apparatus according to claim 2, wherein at least two of said beams form a pair of parallel cross rails, said turntable carries a plurality of rollers riding on said cross rails, and said means for translatably moving said turntable relative to said base includes said cross rails and rollers.

4. Apparatus according to claim 2 wherein said traction means comprises four traction units each attached to a corner of said base by an arm extending from each corner and further including pivot means linking each traction unit to its respective arm whereby each traction unit may pivot about a vertical axis.

5. Apparatus according to claim 4 further including, in each pivot means, means for raising each arm relative to its respective traction unit.

6. Apparatus for cutting a trench in rock comprising:

a generally rectangular base having at least a pair of cross rails, four traction means, each attached to a corner of said base and movably supporting said base, a turntable supported on said cross rails by roller means for providing lateral movement of said turntable along said cross rails, an extendable boom pivotally supported by said turntable, whereby said boom may pivot about a horizontal axis, means for rotating said boom about its longitudinal axis, and a double rock cutter carried by said boom, said rock cutter including a pair of rock cutter wheels attached to opposite ends of a shaft, said shaft having a length, and said boom having a maximum width less than the maximum distance between outside teeth on said cutter wheels.

7. Apparatus according to claim 6 wherein said traction means are attached to said base by arms extending from the corners of said base and each arm ends in a pivot linking said traction means to said arm allowing each traction means to pivot about a vertical axis.

8. Apparatus according to claim 7 further including, in each pivot, means for raising each arm relative to its respective traction means.

9. Apparatus according to claim 1 or claim 6 wherein each allowable motion of said apparatus is hydraulically controlled and said rock cutters are hydraulically driven, further including an engine and at least one hydraulic pump driven by said engine for providing pressurized hydraulic fluid.

10. Apparatus according to claim 1 or claim 6 wherein said double rock cutter is pivotally attached to said extendable boom.

* * * * *

UNITED STATES PATENT AND TRADEMARK OFFICE

CERTIFICATE OF CORRECTION

PATENT NO. : 4,230,372

DATED : October 28, 1980

INVENTOR(S) : Edward N. Marten

It is certified that error appears in the above—identified patent and that said Letters Patent is hereby corrected as shown below:

Column 2, line 56, "is"(second occurence) should be --in--.

Column 4, line 62, "unit" should be --units--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*